US009969181B2

(12) United States Patent
Dashiell et al.

(10) Patent No.: US 9,969,181 B2
(45) Date of Patent: May 15, 2018

(54) PRINTER WITH ADHESIVE CAPABILITIES

(71) Applicant: Iconex LLC, Duluth, GA (US)

(72) Inventors: David Dashiell, Miamisburg, OH (US); Mark E. Keeton, Kettering, OH (US); Joseph D Roth, Springboro, OH (US); Timothy W. Rawlings, Waynesville, OH (US); Michael J. Vandemark, Springboro, OH (US); Jeffery S. Denton, Springboro, OH (US)

(73) Assignee: Iconex LLC, Duluth, GA (US)

( * ) Notice: Subject to any disclaimer, the term of this patent is extended or adjusted under 35 U.S.C. 154(b) by 0 days. days.

(21) Appl. No.: 15/169,014

(22) Filed: May 31, 2016

(65) Prior Publication Data

US 2016/0332463 A1 Nov. 17, 2016

Related U.S. Application Data

(63) Continuation of application No. 12/586,956, filed on Sep. 30, 2009, now Pat. No. 9,352,580, which is a continuation-in-part of application No. 11/968,114, filed on Dec. 31, 2007, now Pat. No. 8,764,323.

(51) Int. Cl.

| | |
|---|---|
| ***B41J 2/32*** | (2006.01) |
| ***B41J 2/325*** | (2006.01) |
| ***B41J 11/00*** | (2006.01) |
| ***B41J 3/60*** | (2006.01) |
| ***B41J 2/01*** | (2006.01) |

(52) U.S. Cl.

CPC ..... *B41J 11/0015* (2013.01); *B41J 2/01* (2013.01); *B41J 2/32* (2013.01); *B41J 3/60* (2013.01); *B41J 2/325* (2013.01)

(58) Field of Classification Search

CPC ..... B41J 2/32; B41J 2/325; B41J 3/407; B41J 3/4075; B41J 11/0015; B41J 3/60; B41J 2/01

See application file for complete search history.

(56) References Cited

U.S. PATENT DOCUMENTS

| | | | |
|---|---|---|---|
| 4,680,080 | A | 7/1987 | Instance |
| 5,043,314 | A | 8/1991 | Suzuki et al. |
| 5,103,583 | A | 4/1992 | Vanermen |
| 5,292,713 | A | 3/1994 | Stenzel et al. |
| 5,686,159 | A | 11/1997 | Langan |
| 5,733,615 | A | 3/1998 | Rackovan et al. |
| 6,017,408 | A | 1/2000 | Rogers et al. |

(Continued)

FOREIGN PATENT DOCUMENTS

| | | | |
|---|---|---|---|
| JP | 2001048139 | A | 2/2001 |
| JP | 2001088814 | A | 4/2001 |

OTHER PUBLICATIONS

"U.S. Appl. No. 11/938,114, Appeal Brief filed Dec. 17, 2012", 12 pgs.

(Continued)

*Primary Examiner* — David Banh

(74) *Attorney, Agent, or Firm* — Schwegman Lundberg & Woessner, P.A.

(57) ABSTRACT

A printer with adhesive capabilities is presented. A printer includes one or more printing elements to image one or two sides of print media. The printer also includes an adhesive element to apply or activate adhesive material on at least one of the two sides of the print media.

5 Claims, 2 Drawing Sheets

(56) References Cited

U.S. PATENT DOCUMENTS 6,037,042 A 3/2000 Kato et al.
6,230,968 B1 5/2001 Varadarajan
6,236,420 B1 5/2001 Matsuzaka
6,326,071 B1 12/2001 Francoeur
6,332,631 B1 12/2001 Kirk
6,388,692 B1 * 5/2002 Iwata ..... B29C 66/0042 156/349
6,485,803 B1 * 11/2002 Bright ..... B29C 63/06 156/86
6,501,495 B1 * 12/2002 Ichikawa ..... B41J 2/32 347/171
6,613,410 B1 9/2003 Sellars
6,737,137 B2 5/2004 Franko et al.
6,941,689 B1 9/2005 Seidl
7,173,642 B2 2/2007 Nureki
8,764,323 B2 7/2014 Keeton
9,352,580 B2 5/2016 Dashiell et al.
2002/0092607 A1 7/2002 Hassenzahl et al.
2002/0155951 A1 10/2002 Shuku et al.
2003/0079830 A1 * 5/2003 Kuller ..... B32B 37/223 156/277
2004/0045953 A1 * 3/2004 Yoshida ..... B41J 2/355 219/486
2004/0081500 A1 4/2004 Hoshino et al.
2004/0161565 A1 8/2004 Dronzek
2004/0184862 A1 9/2004 Shibata et al.
2004/0218961 A1 11/2004 Hoshino et al.
2004/0257424 A1 12/2004 Nureki
2005/0050719 A1 3/2005 Hassenzahl et al.
2005/0076549 A1 4/2005 Sellars
2005/0100689 A1 5/2005 He et al.
2005/0186010 A1 8/2005 Shibata et al.
2005/0208250 A1 * 9/2005 Blank ..... G09F 3/10 428/40.1
2005/0230481 A1 10/2005 Weisz et al.
2006/0035050 A1 2/2006 Hassenzahl et al.
2006/0046931 A1 3/2006 Nakane et al.
2006/0062623 A1 * 3/2006 Kohira ..... B41J 2/32 400/120.18
2006/0083570 A1 * 4/2006 Hoshino ..... B41J 2/325 400/120.16
2006/0088682 A1 4/2006 Dronzek
2006/0130965 A1 * 6/2006 Obuchi ..... B41J 2/32 156/320
2006/0164503 A1 7/2006 Sato et al.
2006/0170755 A1 * 8/2006 Sato ..... B41M 5/26 347/197
2006/0289633 A1 * 12/2006 Moreland ..... B41J 2/32 235/381
2007/0058029 A1 3/2007 Takahashi
2007/0098473 A1 5/2007 Heyse et al.
2007/0211135 A1 9/2007 Moreland et al.
2007/0213214 A1 * 9/2007 Roth ..... B41M 5/40 503/226
2007/0229643 A1 * 10/2007 Takahashi ..... B41J 2/32 347/191
2007/0234618 A1 * 10/2007 Adams ..... G09F 3/0288 40/638
2008/0190561 A1 * 8/2008 Sanbongi ..... B32B 37/1207 156/361
2009/0097955 A1 4/2009 Francis et al.
2009/0258116 A1 * 10/2009 Peyton ..... G09F 3/10 426/87
2009/0277061 A1 11/2009 Jain et al.
2010/0085410 A1 4/2010 Dashiell et al.
2010/0104342 A1 4/2010 Kohira
2010/0120613 A1 5/2010 Denton et al.

OTHER PUBLICATIONS

"U.S. Appl. No. 11/968,114, Final Office Action dated Jun. 24, 2011", 15 pgs.
"U.S. Appl. No. 11/968,114, Non Final Office Action dated Jan. 6, 2011", 16 pgs.
"U.S. Appl. No. 11/968,114, Non Final Office Action dated Dec. 22, 2011", 13 pgs.
"U.S. Appl. No. 11/968,114, Notice of Allowance dated Feb. 28, 2014", 9 pgs.
"U.S. Appl. No. 11/968,114, Response filed Apr. 3, 2011 to Non Final Office Action dated Jan. 6, 2011", 13 pgs.
"U.S. Appl. No. 11/968,114, Response filed Sep. 6, 2011 to Final Office Action dated Jun. 24, 2011", 16 pgs.
"U.S. Appl. No. 12/586,956, 312 Amendment filed Mar. 3, 2015", 5 pgs.
"U.S. Appl. No. 12/586,956, Final Office Action dated Aug. 7, 2012", 12 pgs.
"U.S. Appl. No. 12/586,956, Final Office Action dated Sep. 11, 2014", 12 pgs.
"U.S. Appl. No. 12/586,956, Final Office Action dated Sep. 29, 2015", 10 pgs.
"U.S. Appl. No. 12/586,956, Non Final Office Action dated Mar. 13, 2015", 6 pgs.
"U.S. Appl. No. 12/586,956, Non Final Office Action dated May 23, 2014", 14 pgs.
"U.S. Appl. No. 12/586,956, Non Final Office Action dated Dec. 23, 2011", 14 pgs.
"U.S. Appl. No. 12/586,956, Notice of Allowance dated Jan. 13, 2016", 5 pgs.
"U.S. Appl. No. 12/586,956, Notice of Allowance dated Dec. 8, 2014", 5 pgs.
"U.S. Appl. No. 12/586,956, Response filed May 22, 2012 to Non Final Office Action dated Dec. 23, 2011", 12 pgs.
"U.S. Appl. No. 12/586,956, Response filed Jun. 11, 2015 to Non Final Office Action dated Mar. 13, 2015", 8 pgs.
"U.S. Appl. No. 12/586,956, Response filed Aug. 25, 2014 to Non Final Office Action dated May 23, 2014", 10 pgs.
"U.S. Appl. No. 12/586,956, Response filed Nov. 4, 2012 to Final Office Action dated Aug. 7, 2012", 11 pgs.
"U.S. Appl. No. 12/586,956, Response filed Nov. 12, 2014 to Final Office Action dated Sep. 11, 2014", 6 pgs.
"U.S. Appl. No. 12/586,959, Response filed Dec. 10, 2015 to Final Office Action dated Sep. 29, 2015", 5 pgs.

* cited by examiner

PRINTER WITH ADHESIVE CAPABILITIES

RELATED APPLICATIONS

This Application is a continuation of U.S. patent application Ser. No. 12/586,956, filed Sep. 30, 2009, entitled "A Printer with Adhesive Capabilities," now issued as U.S. Pat. No. 9,288,669; U.S. patent application Ser. No. 12/586,956 was a Continuation-In Part of U.S. Ser. No. 11/968,114 filed on Dec. 31, 2007 entitled: "Heat-Activated Linerless Label;" now issued as U.S. patent application No. 8,764,323; the disclosures of which are incorporated by reference herein in its entirety.

BACKGROUND

Enterprises and individuals are increasingly demanding more complex printing solutions. That is, printing features, which use to require a separate professional service, are now being demanded by consumers. Sending print jobs to special facilities can be time consuming and costly for an enterprise. So, consumers are demanding machinery to perform the complex printing jobs on their premises.

In large part, the print industry's responses to these demands have been to provide multiple types of machines to augment an enterprise's printers. The print industry has also sought to alleviate the consumers' demands with special types of media, each media type having its own unique characteristics.

Media that includes adhesive materials typically has to be processed by a special type of adhesively-sensitive machine, whereas media requiring dual-sided imaging requires another special type of printer. As a result, enterprises carry multiple types of printers and machines, each printer or machine type for a specific need of the enterprises.

This situation is costly for an enterprise and causes support issues because when one type of printer or machine breaks down or fails, the failed printer or machine cannot be swapped out with another type of printer or machine that remains operational.

In addition, in some enterprises application of adhesive material or activation of adhesive material is a manual process. That is, a person is tasked with applying or activating the adhesive material on print media following print jobs in what amounts to a costly and labor-intensive task.

SUMMARY

In various embodiments, a printer with adhesive material application and/or activation capability is presented. According to an embodiment, a printer is presented. The printer includes a printing element and an adhesive element. The printing element is configured to image media. The adhesive element is configured to apply an adhesive material to a portion of the media and/or activate the adhesive material on the media.

DETAILED DESCRIPTION

Figure 1:
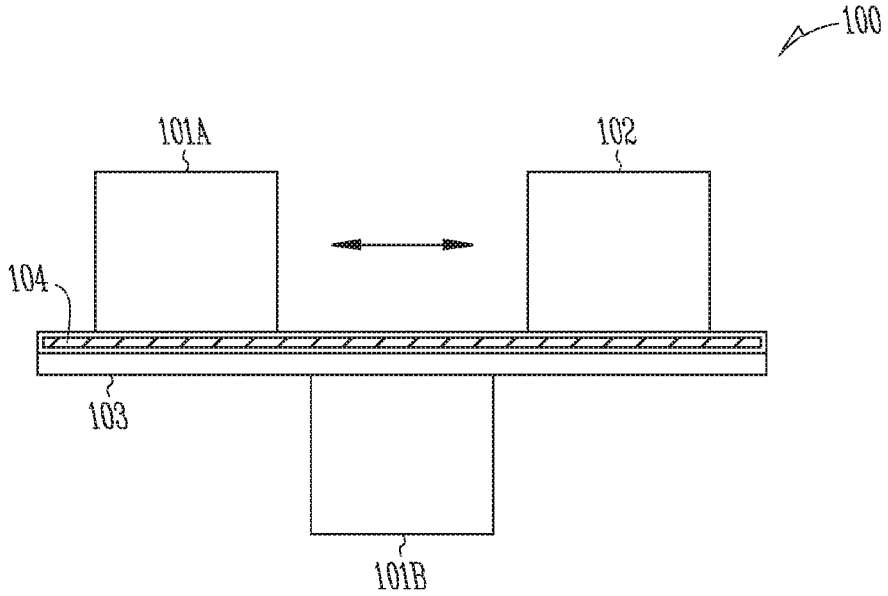
FIG. 1 is a diagram of a printer with adhesive capabilities, according to an example embodiment.

FIG. 1 is a diagram of a printer with adhesive capabilities 100, according to an example embodiment. The printer with adhesive capabilities 100 (hereinafter "printer") can be a thermal printer 100, a dual-sided thermal printer 100, an inkjet printer 100, or a dual-sided inkjet printer 100.

Moreover, the printer 100 can include one or more processors configured to execute a variety of software instructions that reside in computer-readable storage media within the printer 100. Additionally, the printer 100 can be interfaced to a network and accessible over a network. The network can be a wide-area network (WAN), such as the Internet, or a local-area network (LAN) located within a firewall of an enterprise.

The printer 100 includes, inter alia, a printing element 101A and an adhesive element 102. In embodiment, the printer 100 also includes a second printing element 1018 when the printer 100 has dual-sided imaging capabilities. Each of these and their interactions with one another and the printer 100 is now discussed with reference to the FIG. 1.

The dual-sided direction arrow depicted in the FIG. 1 is intended to convey that the print media 103 can pass through the printer 100 from either direction. So, the adhesive element 102 can interface with the print media 103 before the printing element(s) 101A-101B. Conversely, the printing element(s) 101A-101B can interface with the print media 103 before the adhesive element 102.

The printing element 101A is configured to image print media 103 as the print media is passed through the printer 100. Imaging occurs in accordance with a print job sent to one or more processors of the printer 100 that activate the printing element 101A to image on the print media 103.

According to an embodiment, the printing element 101A includes dual thermal print heads 101A and 101B configured to interface with the print media 103 on opposite sides of the print media 103 as the print media 103 passes through the printer 100. In this embodiment, both sides of the print media 103 are selectively imaged in accordance with a print job's and/or local processor directed instructions. Additionally, the print media 103 in this embodiment is coated on first and second sides with one or more thermally-sensitive inks for interfacing with and imaging by the first 101A and second 101B thermal print heads, respectively.

In another case, the printing element 101A or 101B is a single-sided thermal print head configured to interface to and image on one side of the print media 103, which may be coated on a first and/or second side with one or more thermally sensitive inks.

It is also noted, that in some cases the printing element(s) 101A and/or 101B can be one or two inkjet print heads capable of printing in one or more colors on the print media 103.

The adhesive element 102 is configured within the printer 100 to apply an adhesive material 104 to all or a portion (i.e. spot, strip, stripe, stippled, patterned, etc.) of a side of the print media 103. Alternatively, the adhesive element 102 is configured within the printer 100 to activate the adhesive material 104 that already exists on all or a portion of the print media 103.

Again, and as stated above, the adhesive element 102 can be configured and/or controlled (e.g., via the processor) to interface with the print media 103 before or after the printing element(s) 101A-101B interface with the print media 103.

According to an embodiment, the adhesive element 102 is configured to apply the adhesive material 104 as a rolling mechanism, a spraying mechanism, or transferred from a roll. That is, the adhesive element 102 is a roller, a sprayer, or a roll of tape. Here, double-sided tape can be the adhesive material 104 when the adhesive element 102 is a roll of tape. In another case, the adhesive element 102 can be a transfer tape roll that transfers via a rolling motion of the adhesive material 104 onto the print media 103.

In cases where the adhesive element 102 is a sprayer or a roller, the adhesive element 102 squirts, brushes, or otherwise dispenses adhesive material 104 (glue, etc.) onto the print media 103.

In configurations where the adhesive element 102 activates an already-existing adhesive material 104 present on the print media 103, the adhesive element 102 can activate the adhesive material 104 via a heating mechanism (e.g., a thermal print head), a pressure mechanism (e.g., a roller), and/or a liquid and/or gas (water, steam, etc.) dispensing mechanism.

For example, during manufacture of the print media 103, the print media 103 may have an adhesive material 104 integrated onto the print media 103. The adhesive material 104 is protected via an applied liner (such as silicone) to prevent the adhesive material 104 from sticking. Here, the adhesive element 102 is configured to remove the liner from the print media 103 and expose and thereby activate the adhesive material 104.

In other cases, heat activated adhesive materials 104 can be pre-applied and present on the print media 103. In these cases, the adhesive element 102 can activate the adhesive materials 104 via a variety of mechanisms such as: direct heat applied by a contact heater acting as the adhesive element 102; indirect heat applied by any type of radiant heater acting as the adhesive element 102; and/or infrared (IR) light-emitting diodes (LED's) that emit IR light to activate the adhesive materials 104, where the ID LED's act as the adhesive element 102.

In a particular embodiment, discussed below with reference to the FIG. 2, the adhesive material 104 is activated via heat that is applied from the printing element 101A, where the printing element 101A is a thermal print head. Here, the printing element 101A and the adhesive element 102 are integrated as one component of the printer (not shown in the FIG. 1 but depicted in the FIG. 2 as elements 201 and 203).

In still another embodiment where the adhesive element 102 is used to activate a pre-existing adhesive material 104, the adhesive element 102 is a liquid dispensing mechanism. Here, the adhesive material 104 can be a dry gum adhesive that becomes tacky when exposed to moisture (similar to postage stamps). The adhesive element 102 in this instance is a liquid or water source that is squirted, rolled, or brushed onto the print media 103 to activate the adhesive material 104.

In some instances, the adhesive element 102 is a removable consumable within the printer 100. That is, the adhesive element 102 includes a supply of the adhesive material 104, much like ink jet printer cartridges include supplies of ink. Consumers remove the adhesive element 102 when it is empty and replace it with a new adhesive element 102 having a new supply of the adhesive material 104.

In the situation where the adhesive element 102 is a liquid dispenser used to dispense liquid, such as water, to activate a pre-existing adhesive material 104, the adhesive element 102 is a refillable consumable that a consumer can refill with the liquid (water, etc.) when the supply of liquid within the adhesive element 102 becomes depleted.

One now appreciates how an enhanced printer 100 can be used to enhance printing services for consumers. The printer 100 can not only image print media 103 but also apply or activate adhesive materials 104 on at least one side of the print media 103. This eliminates the need for dual machinery within an enterprise and/or eliminates the manual application of adhesive materials to print media.

Figure 2:
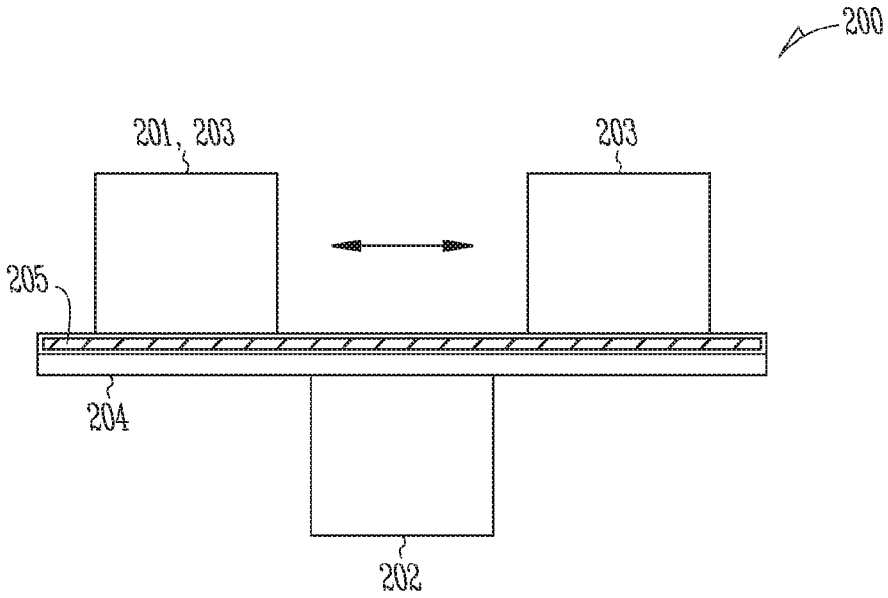
FIG. 2. is a diagram of another printer with adhesive capabilities, according to an example embodiment.

FIG. 2. Is a diagram of another printer with adhesive capabilities 200, according to an example embodiment. The printer with adhesive capabilities 200 (hereinafter "printer") is a dual-sided thermal printer 200. Moreover, the printer 200 can include one or more processors configured to execute a variety of software instructions that reside in computer-readable storage media within the printer 200. Additionally, the printer 200 can be interfaced to a network and accessible over a network. The network can be a wide-area network (WAN), such as the Internet, or a local-area network (LAN) located within a firewall of an enterprise.

The printer 200 represents another and in some cases specific configuration for the printer 100, presented above with respect to the discussion of the FIG. 1.

The printer 200 includes, inter alia, a first thermal print head 201, a second thermal print head 202, and an adhesive mechanism 203. Each of these and their interactions with one another and the printer 200 is now discussed with reference to the FIG. 2.

The first thermal print head 201 is configured to thermally image on a first side of a print media 204. This is done by the first thermal print head 201 selectively applying heat to the first side of the print media 204 to selectively activate thermally-sensitive inks that are coated on the first side of the print media 204 and become visible to the human eye when activated.

Similarly, the second thermal print head 202 is configured to thermally image on a second side of the print media 204. Again, the second thermal print head 202 selectively applies heat to the second side of the print media 204 to selectively activate thermally-sensitive inks coated on the second side of the print media 204.

The adhesive mechanism 203 is configured to apply or activate adhesive material 205 on all or selective portions of the second side of the print media 204. Some example configurations of the adhesive mechanism 203 was discussed and presented above with reference to the adhesive element 102 of the printer 100 in the FIG. 1.

According to an embodiment, the adhesive mechanism 203 is a roller that is configured to roll tape onto the selective portions of the second side of the print media 204. Here, the tape is the adhesive material 205.

In another configuration, the adhesive mechanism 203 is configured to spray the adhesive material 205 onto the selective portions of the second side of the print media 204. Here, the adhesive mechanism 203 is a sprayer or spraying device.

In still another case, the adhesive mechanism 203 is configured to apply heat to activate a pre-existing adhesive material 205 that was pre-coated onto the selective portions or all of the second side of the print media 204.

In one particular configuration of the latter embodiment, the adhesive mechanism 203 is included within, is integrated with, or is part of the first thermal print head 201 (depicted in the box of the FIG. 2 showing both reference numerals 201 and 203).

During an operational aspect of the printer 100 and in an embodiment, the first and second print heads 201 and 202 are configured to distinctively image the first and/or second sides of the print media 204 to delineate the portions have the adhesive material 205 or to indicate that the adhesive material 205 is present or is activated on the print media 204.

For example, one or both of the thermal print heads 201 and/or 202 can make a positive indication (via selective images) on the print media 204 that the adhesive material 205 has been applied to and/or activated on the print media 204. So, for example, black borders can be imaged on the print media 204 to signify that adhesive material 205 was activated on the print media 204. Alternatively, the thermal print head(s) 201 and/or 202 can image marks proximate to or around an area (selective portions) of the print media 204 where the adhesive material 205 is applied and/or activated on that print media 204.

Figure 3:
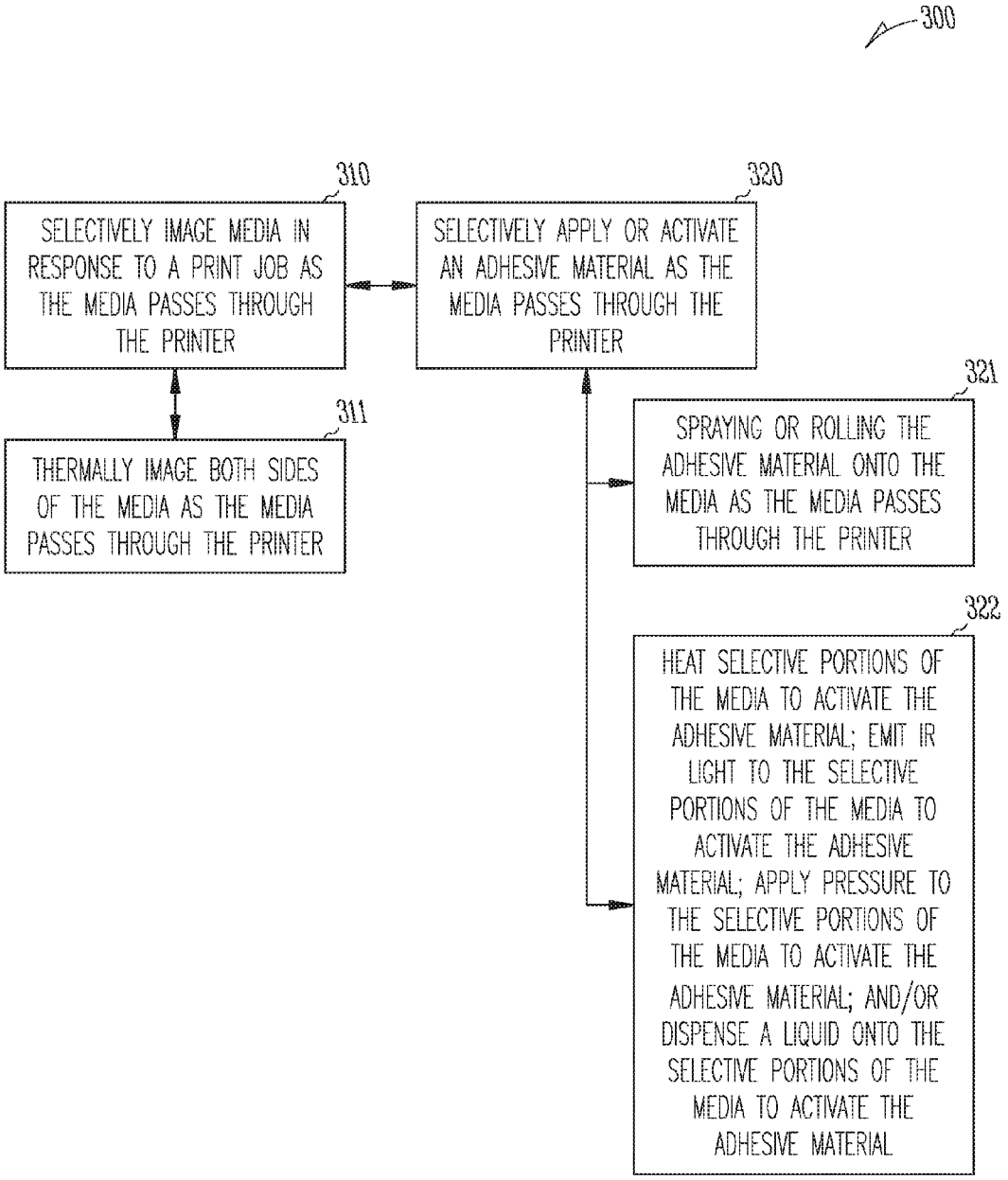
FIG. 3 is a diagram of a method for operating a printer with adhesive capabilities, according to an example embodiment.

FIG. 3 is a diagram of a method 300 for operating a printer (100 and/or 200) with adhesive capabilities, according to an example embodiment. The method 300 (hereinafter "printer adhesive service") resides in a computer-readable storage medium and is executed on one or more processors of a printer, such as printers 100 and 200 of the FIGS. 1 and 2, respectively. The printer adhesive service may be accessible and operational over a network. The network may be wired, wireless, or a combination of wired and wireless. Moreover, the network may be a WAN and/or LAN.

The printer adhesive service represents processing that can occur on processors of the printers 100 and 200 of the FIGS. 1 and 2, respectively.

At 310, the printer adhesive service controls the selective imaging of print media in response to instructions received with a print job executing on the printer.

According to an embodiment, at 311, the first and/or second thermal print heads selectively thermally image one or both sides of the print media as the print media passes through the printer according to the direction of the printer adhesive service. Here, the printer is a dual-sided thermal printer. The selective imaging occurs as the print media is passed through the printer.

In another case, the printer adhesive service controls imaging of one or both sides of the print media via a printer that comprises inkjet printing elements. In still another situation, the printer adhesive service thermally images just one side of the print media as it passes through a thermal printer.

At 320, the printer adhesive service controls selective application or activation of an adhesive material as the print media passes through the printer. A variety of situations and configurations for structurally achieving this via the printer was presented in detail above with reference to the printers 100 and 200 of the FIGS. 1 and 2, respectively.

According to an embodiment, at 321, the printer adhesive service controls selective application of the adhesive material by instructing the printer to spray or roll the adhesive material or apply tape onto the print media as the print media passes through the printer.

In another set of circumstances, at 322, the printer adhesive service causes the printer to activate a pre-existing adhesive material coated on the print media as the print media passes through the printer by one or more of the following: heating selective portions of the print media; emitting IR light to the selective portions of the print media; applying pressure to the selective portions of the print media; and/or dispensing a liquid onto the selective portions of the print media.

It is noted that the numbering of the FIG. 3 is not intended to impart a sequential ordering. So, for example, in some configurations, the processing at 320 can occur before the processing at 310. In other configurations, the processing at 310 occurs before the processing at 320.

Additionally, in some configurations the media can be partially or completely images while passing in a first direction through the printer and then the media can reverse directions (second direction) within the printer and receive the adhesive materials. So, imaging can occur with the media moving in a first direction within the printer while adhesive application occurs when the media moves in a second and different direction within the printer.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. § 1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A printer, comprising:

a printer element;

an adhesive element; and a processor configured to:

i) activate the adhesive element to apply an adhesive material on media when the media is conveyed in a first direction along a transport path before activating the printer element to image the media when the media is conveyed in a second direction along the transport within the printer, and (ii) activate the printer element to image the media when the media is conveyed in the second direction along the transport path and after the processor has activated the adhesive element, wherein the first direction is an opposite and different direction from the second direction, and wherein the printer element includes dual thermal print heads configured to apply heat for imaging both sides of the media.

2. The printer of claim 1, wherein the adhesive element is further configured to apply the adhesive material on the media as one or more of:

a spot, a strip, a stripe, a stipple, and a pattern.

3. The printer of claim 1, wherein the adhesive element is further configured to apply the adhesive material on the media by one of:

rolling, spraying, and transferring the adhesive material from a roll of double-sided tape.

4. A printer, comprising:

a first print head;

a second print head;

an adhesive element;

wherein the first print head is configured to thermally image a first side of media provided along a transport path in a first direction while the second print head is configured to simultaneously image a second side of the media, and wherein the adhesive element is configured to apply adhesive material on the first side or second side of the media when the media is provided along the transport path in a second direction, and wherein the printer is configured to activate the adhesive element to apply the adhesive material before the printer activates the first and second print heads to image the first and second sides of the media, wherein the first direction is an opposite and different direction from the second direction.

5. The printer of claim 4, wherein the adhesive element is configured to dispense the adhesive material onto the media to apply the adhesive material on the media.

* * * * *